United States Patent [19]

Dunicz

[11] 4,143,690

[45] Mar. 13, 1979

[54] SPILL FREE FLUID TRANSFER FUNNEL

[76] Inventor: Boleslaw L. Dunicz, 8 Locksley Ave., 1H, San Francisco, Calif. 94122

[21] Appl. No.: 808,983

[22] Filed: Jun. 22, 1977

Related U.S. Application Data

[63] Continuation-in-part of Ser. No. 576,017, May 9, 1975, abandoned.

[51] Int. Cl.[2] ..... B67C 11/02

[52] U.S. Cl. ..... 141/333; 141/392; 222/567

[58] Field of Search ..... 222/567; 141/392, 98, 141/331-345, 297-300, 199-205

[56] References Cited

U.S. PATENT DOCUMENTS

| | | | |
|---|---|---|---|
| 1,446,751 | 2/1923 | Kadavy | 222/567 |
| 3,310,077 | 3/1967 | Mero | 141/392 |

*Primary Examiner*—Houston S. Bell, Jr.

*Attorney, Agent, or Firm*—Edward B. Gregg; J. Michael Rosso

[57] ABSTRACT

A funnel device for the transference of fluid from a spout-equipped container to a fluid receiving body, the device having a domed portion with an opening just sufficient to allow insertion of the spout of the spout-equipped container, and an eduction nose for conduiting the fluid into the receiving body. The device may include a swiveling clamp to detachably and flexibly hinge the spout of the spout-equipped container within the opening of the device, permitting ease in manipulation of the combined units.

2 Claims, 4 Drawing Figures

SPILL FREE FLUID TRANSFER FUNNEL

This application is a continuation-in-part of my copending application Ser. No. 576,017, filed May 9, 1975, now abandoned, and incorporates by reference the subject matter contained therein.

BACKGROUND OF THE INVENTION

Chemical laboratory work often entails the transfer of hazardous fluids from one vessel to another. The hazards encountered derive from the corrosiveness of the fluids or liquids and the irritating or poisonous fumes, emanating therefrom.

In many cases, the spillage of liquids during the transfer process may result in environmental damage. In most instances, however, spillage of the liquids being transferred amounts to a mere nuisance.

Although there are many hazardous situations which might arise during liquid transfers, the following are simply examples disclosed for the purpose of presenting a clear description of the present invention.

Mercury — When pouring mercury (liquid at room temperature) from one vessel to another, small airborne droplets thereof form and tend to spray outside the normal confines of an open receiving vessel. Mercury is known to be quite hazardous to humans in its liquid and vapor forms.

Hydrofluoric Acid — The liquid form of this acid is extremely corrosive, even in a fairly diluted state. Burns on the human skin require a lengthy time to heal.

Concentrated Nitric Acid and Bromine — These liquids are corrosive and exude corrosive and irritating fumes to the ambient air.

Transference of liquids between vessels presently take place by simply pouring the liquid from one container to another or by employing a conduit, such as a conventional funnel and the like.

The presently known methods of liquid transfer do not solve the problems described hereabove.

SUMMARY OF THE INVENTION

In accordance with the present invention there is provided a spill-free funnel device having a domed portion with an opening therein for entry of a spout of a spout-equipped fluid container. The funnel device terminates in an eduction nose which enters the fluid receiving body. Fluids transferred from the fluid container into the fluid receiving body are poured via the funnel device without splashing or volatilization of the fluid into the ambient environment.

The funnel device may employ a springy clamp means fitting over the spout of the fluid container for flexibly bracing the edges of the opening in the dome portion of the funnel, thus permitting a person to use one hand in manipulating the vessel in combination with the funnel.

It is an object of the present invention to provide a device usable for transference of fluids between vessels without spillage or vapor leakage.

It is another object of the present invention to prevent damage caused by the splashing and back-splashing of dangerous fluid during their movement between vessels.

It is a further object of the invention to provide a device allowing for safe transfer of fluids between vessels such that the delivery vessel and the funnel device can be manipulated with one hand of the user. In this respect the device may incorporate a springy clamp that permits flexible tilting of the transferring vessel with respect to the device.

The invention possesses other objects and advantages especially as concerns particular features and characteristics thereof, which will become apparent as the specification continues.

For a better understanding of the invention, reference is made to the following detailed description.

DESCRIPTION OF THE PREFERRED EMBODIMENTS

Figures 1, 2, 3, 4:
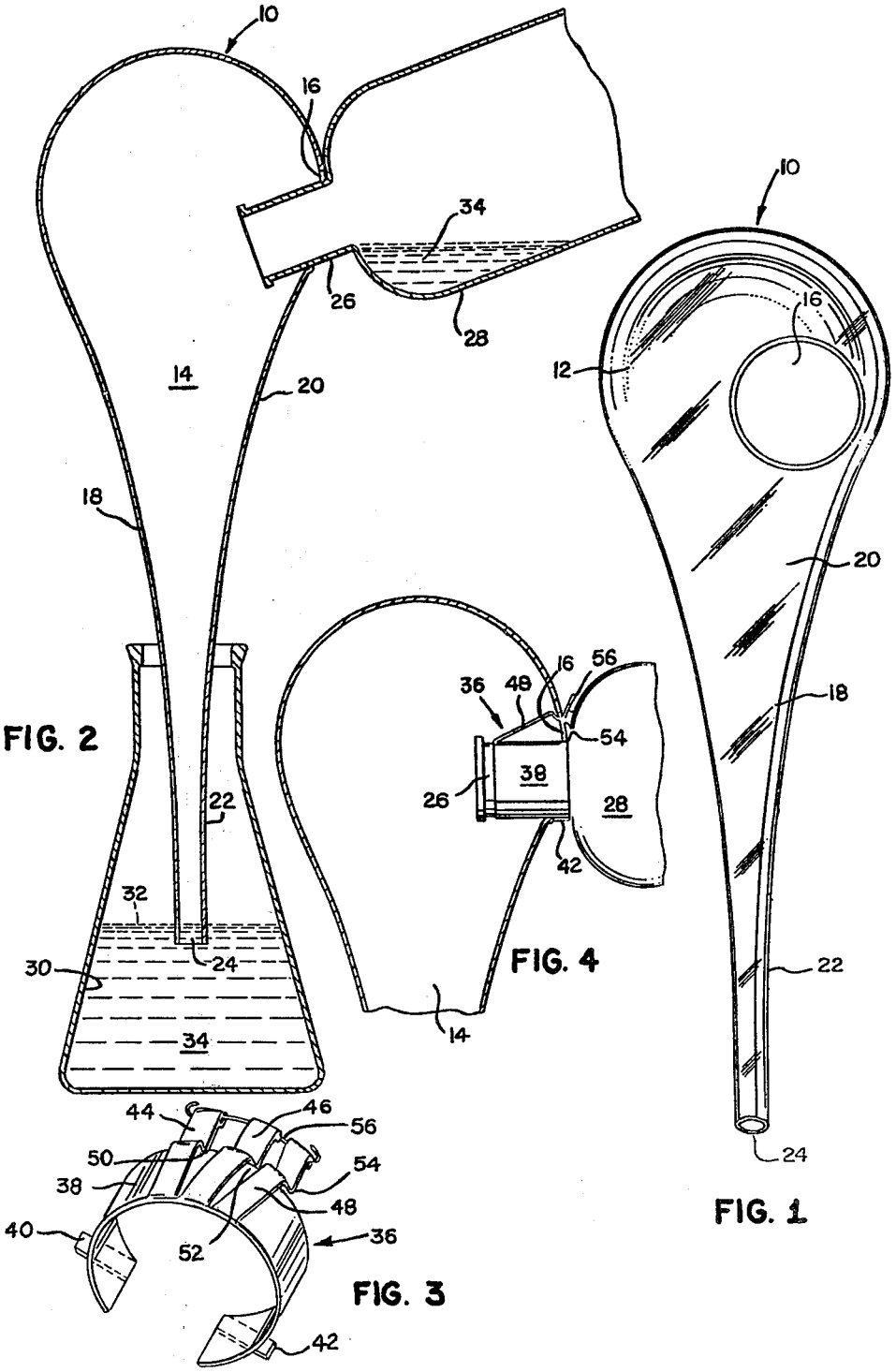
FIG. 1 is a side elevational view of the device.
FIG. 2 is a broken sectional view of the device used with a spout-equipped container and fluid receiving body.
FIG. 3 is a perspective view of the springy clamping means.
FIG. 4 is a broken sectional view of the device and the clamping means used with the spout-equipped container.

The device depicted in the drawings is designated as a whole by reference character 10 and includes a domed shell 12 having an opening 16 located at the middle periphery of the shell (between the zone indicated by 14 and the top of the dome). The shell 12 may take any shape and is illustrated in FIGS. 1, 2 and 4 as being spherically contoured. For instance, the shell 12 may have a flattened dome (not shown) for resting the device 10 on a bench in the upside down position.

The device includes an eduction nose 18 which extends downwards from the zone 14. The end portion 22 of the eduction nose terminates in opening 24. As shown in FIGS. 1, 2 and 4, the eduction nose 18 is generally an elongated tube having a slightly tapered lower end portion 22. The nose 18 designedly fits within a receiving body such as container 30 and may extend to below the surface 32 of fluid 34, FIG. 2.

The device 10 may be constructed of any material, for example, glass, plastic, metal and the like.

Opening 16, although allowing entry of spout 26, also permits the flow of air into container 28 during the pouring process.

When the user desires not to use a hand to hold the device 10, but to hold container 28 only (either as a convenience or because both hands must be engaged in holding the container 28 due to its bulk or weight), a springy clamp means 36 may be employed, as shown in FIGS. 3 and 4. The clamping means 36 suspends device 10 hingewise with its opening 16 around the spout 26 of the container 28, and thereby allows a swiveling action therebetween. Thus the angle between the axes of the container 28 and of the device 10 may be conveniently and continuously adjusted during the transference of the liquid to fluid receiving body 30.

Clamp means 36 may take many forms and the preferred embodiment is shown in detail by FIG. 3, which includes a split, flexible collar 38. Collar 38 has a pair of legs 40 and 42 on either side, which offers a measure of support and serves to position the spout 26 within opening 16. Collar 38 also includes a triad of springs 44, 46 and 48 including recesses 50, 52 and 54 which engage the lip of opening 16. Rod 56 stiffens the end portions of springs 44, 46 and 48. The pushing action of springs 44, 46 and 48 holds device 10 to container 28. Resilient action of springs 44, 46 and 48 permits the swiveling of container 28 with respect to device 10 during the transfer of fluid 34.

In operation, spout 26 of container 28 fits into opening 16 of device 10. Eduction nose 18 positions within receiving body 30 to direct the fluid thereinto. The container 28 tilts until a flow of fluid 34 obtains and passes through device 10 and into body 30. It should be noted that vapor, fumes, droplets and the like, concommitant with the transfer of fluid 34, are contained by domed shell 12. Thus, an efficient and safe transfer takes place. Further, splashing in body 30 may be eliminated by positioning end portion 22 of eduction nose 18 below fluid surface 32, as previously discussed.

Employment of clamp means 36 allows the user to make the transfer by supporting only container 28 since device 10 remains flexibly joined to container 28 during transfer of fluid 34. Exertion of a force by eduction nose 18 on body 30 adjusts the angle of container 28 with respect to device 10. As may be seen, the user may effect such angular disposition without touching device 10.

While in the foregoing specification embodiments of the invention have been set forth in considerable detail for purposes of making a complete disclosure of the invention, it will be apparent to those of ordinary skill in the art that numerous changes may be made in such detail without departing from the spirit and principle of the invention.

I claim:

1. A funnel device for spill-free, and fume escape inhibiting transfer of fluid into a fluid receiving vessel from a container equipped with a tubular orifice, said device being formed with an upper domed portion and a lower eduction nose, said nose tapering downwardly to a narrow terminus for protruding into said fluid receiving vessel, said eduction nose being continuous at its upper end with the lower end of said domed portion, said domed portion having a side opening in a side wall thereof for admitting the tubular orifice of said container, said domed portion combined with said eduction nose providing a chamber which is completely closed except for said side opening and said terminus, said side opening serving to permit the insertion and removal of a tubular orifice of a container from which fluid is being transferred and being of a size to permit easy insertion and removal of such orifice but small enough to inhibit escape of liquid and vapor during such transfer except through the eduction nose.

2. The funnel device of claim 1 additionally comprising a springy clamp means for detachably and flexibly hinging the spout of the spout-equipped container within the opening of the domed portion of the funnel device, thereby allowing the user of said device to manipulate the container without having to hold the funnel device.

* * * * *